United States Patent [19]

Tannenbaum et al.

[11] Patent Number: 5,052,812

[45] Date of Patent: Oct. 1, 1991

[54] BATH SHAKER

[75] Inventors: Myron Tannenbaum, East Brunswick; Alan Husson, Long Valley, both of N.J.

[73] Assignee: New Brunswick Scientific Co., Inc., Edison, N.J.

[21] Appl. No.: 615,076

[22] Filed: Nov. 19, 1990

[51] Int. Cl.[5] ..... B01F 11/00; B01F 15/06

[52] U.S. Cl. ..... 366/209; 366/145; 366/146; 366/153; 366/219

[58] Field of Search ..... 366/208, 209, 213, 214, 366/215, 216, 218, 219, 144, 145, 146, 151, 153

[56] References Cited

U.S. PATENT DOCUMENTS

| | | | |
|---|---|---|---|
| 2,520,556 | 8/1950 | Massey | 366/209 |
| 3,220,704 | 11/1965 | Phillips . | |
| 3,430,926 | 3/1969 | Freedman et al. . | |
| 3,601,372 | 8/1971 | Harmon . | |
| 4,047,704 | 9/1977 | Hawrylenko . | |
| 4,109,319 | 8/1978 | Brandt . | |
| 4,202,634 | 5/1980 | Kraft | 366/208 |
| 4,673,297 | 6/1987 | Siczek et al. . | |
| 4,702,610 | 10/1987 | Reynolds | 366/208 |
| 4,747,693 | 5/1988 | Kahl . | |
| 4,750,845 | 6/1988 | Nabetani . | |
| 4,923,305 | 5/1990 | Hawrylenko . | |

*Primary Examiner*—Robert W. Jenkins

*Attorney, Agent, or Firm*—Mathews, Woodbridge & Collins

[57] ABSTRACT

A water bath shaker having a water bath, a vessel-mounting shelf and a triple-eccentric drive, whereby the shelf is subjected to orbital gyratory motion via a drive shaft consisting of a single post that extends into the center of the bath via a standpipe. The drive shaft also acts as a mount that can removably receive and support any one of a variety of dedicated and universal shelves. A microprocessor control performs self-correcting feedback control of temperature and shaker speed. A push-button means is used to input set points.

16 Claims, 12 Drawing Sheets

| |
|---|
| FIG. 8A |
| FIG. 8B |
| FIG. 8C |

BATH SHAKER

BACKGROUND OF THE INVENTION

1. Field of the Invention

The present invention relates to bath shakers and, more particularly, to machines having means for vibrating a plurality of vessels while they are immersed in a liquid bath.

2. Description of the Prior Art

In the field of chemical and biological testing and research, it is often necessary to mix a number of substances together by placing the substances in a vessel and then shaking the vessel for an extended period of time. Rotary shaker machines have been widely used in the past for this purpose. Such shakers typically include one or more shelves on which are fixed a plurality of vessel-mounting clamps for holding such laboratory items as flasks, bottles, beakers, etc. The shelves are moved by a drive mechanism so that the contents of the vessels are agitated. A typical drive mechanism includes an eccentrically driven shaft on which a frame is mounted for supporting the shelves. In response to operation of the drive mechanism, the shaft causes the frame to gyrate, orbit or otherwise move thereby causing the shelves and vessels to shake. Descriptions of conventional shakers can be found in the following U.S. Pat. Nos.: 4,750,845; 4,747,693; 4,673,297; 4,109,319; 4,047,704; 3,430,926 and 3,220,704.

In some cases it is also desirable that, while the mixing is being performed, the substances be maintained at a particular temperature. To accomplish this, the vessels in which the substances are mixed are often immersed in a temperature-controlled liquid bath. To ensure that the substances are thoroughly mixed or kept in suspension with each other, the vessels are continuously shaken while they are immersed in the bath. Machines, called bath shakers, are available for performing this task.

Bath shakers typically include a tank for holding a water bath, a heater or cooler for maintaining the water at some predetermined temperature, a shelf for supporting the mixing vessels while immersed in the water, and a shaker for orbiting the shelf. U.S. Pat. No. 3,601,372 illustrates the structural details of a typical bath shaker. Additional prior art bath shakers and their drive mechanisms are illustrated in Catalog S28730BP, "Biological Shakers", published by New Brunswick Scientific, Edison, N.J.

As is evident from these references, developers of bath shakers have long recognized the need for making improvements to the drive mechanisms thereof. For example, the '372 patent describes a shaker wherein a shelf, a triple-eccentric drive mechanism and a first permanent magnet are mounted in a water bath. A second permanent magnet, mounted external of the water bath, is rotated by a motor to produce a rotating magnetic field that drives the first magnet. In turn the first magnet drives the triple-eccentric mechanism which in turn causes the shelf to orbit. The drive mechanism of the '372 shaker does not require the use of structures that must pass through the walls of the water bath. As such, the principles of the '372 patent have been successfully used to construct leakage-free bath shakers. However, one disadvantage with a '372-type shaker is the location of the triple-eccentric drive mechanism in the water bath, requiring the use of expensive waterproof bearings.

The water bath shaker shown on page B-34 in the New Brunswick Scientific Catalog S28730BP, referred to therein as Model G76, has a triple-eccentric drive mechanism that is mounted external to and below the water bath. Four arms extend outwardly from the drive mechanism, up and around the exterior of the bath-shaker housing, and over the upper edges of the housing where they terminate on either side of the shaker above the water bath. A vessel-carrying shelf has four rigid vertical hangers that are attached to the arms for suspending the shelf in the bath.

The G76 bath shaker is an improvement over the device of the '372 patent in the sense that the entire drive mechanism, including the triple eccentric, is mounted external of the water bath. However, the external arms of the G76 shaker are in some cases a disadvantage since they increase the exterior size of the overall device which in turn increases the amount of linear bench space occupied by the bath shaker. Other conventional bath shakers with external arms are the Lab-Line Model 3545, as shown on pages S-11 of the brochure LAB-LINE SHAKERS, and the Bellco Sci/-ERA Water Bath Shaker.

U.S. Pat. No. 4,923,305 discloses still another type of bath shaker. The shaker of the '305 patent has a tub in the form of a closed circular ring with a central passage for a drive shaft. A shelf, essentially constructed as a circular ring, is mounted at the upper end of the drive shaft so as to be immersed in the water while agitated by the drive shaft. Although the '305 shaker does not include external arms, its circular shape is an equally inefficient contour in utilizing linear bench space. An implementation of a circular shaker is illustrated as model "HT, Aquatron Waterbath Rotary Shaker" in a brochure, YP251284e, published by INFORS AG, the assignee of the '305 patent.

Other shakers of general interest are produced by Adolf Kuhner AG of Switzerland and by GCA Corp. of Chicago, Ill.

Although there has been a long recognized need for improvements in several bath shaker features, no prior art device has been devised that resolves many of the current shortcomings. Ideally, an improved bath shaker would be shaped to occupy a minimum of linear bench space, thereby increasing the number of devices that may be placed side-by-side; would be easy to repair, maintain and clean; would include a simple, efficient drive mechanism wherein all bearing surfaces are quiet, smooth and substantially isolated from the water bath; would have a relatively large capacity; and would operate efficiently with little or no adverse splashing at high speeds and during start up. The present invention fulfills this need.

SUMMARY OF THE INVENTION

The general purpose of this invention is to provide a bath shaker which embraces all of the advantages of similarly employed devices and possesses none of the aforementioned disadvantages. To attain this, the present invention contemplates a unique combination of a water bath, a vessel-mounting shelf and a triple eccentric drive, whereby the shelf is subjected to orbital gyratory motion via a drive shaft consisting of a single post that extends into the center of the bath. The post also acts as a mount that removably receives and supports any one of a variety of dedicated and universal shelves to provide flexibility and/or maximum capacity when needed. The triple eccentric drive requires no other mechanism to prevent the shelf from rotating, allowing a true orbit of the shelf (i.e. the shelf orbits but it is always parallel to the water bath sidewalls).

Still further, there is provided a microprocessor control that achieves self-correcting feedback control of temperature and shaker speed. Also included is a push-button means for inputting set points, and self-diagnostic status lights and an alarm that warns of any functional deviation. Because of the microprocessor control the system is capable of compensating automatically for changes in workload and voltage to maintain the set points within control tolerances. The shaker can have a broad speed range while being capable of imparting either a gentle stirring action, such as needed for the growth of sensitive cells, or vigorous agitation and aeration, such as needed for the growth of bacterial cultures. To avoid sudden starts and unwanted splashing, the shaking speed may be controlled by a digital acceleration routine so that the speed builds up to the set point gradually.

The exact nature of this invention as well as other objects and advantages thereof will be readily apparent from consideration of the following specification relating to the annexed drawings.

DETAILED DESCRIPTION OF THE PREFERRED EMBODIMENT

Figure 1:
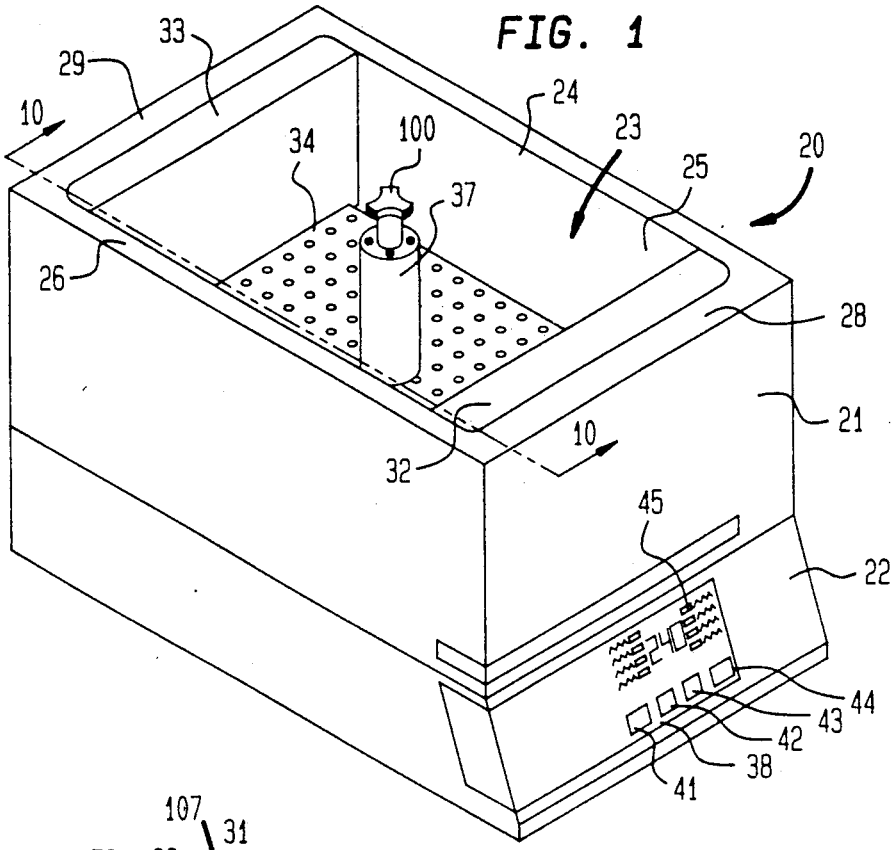
FIG. 1 is a pictorial view of the preferred embodiment.

Referring now to the drawings, wherein like reference characters represent like or corresponding parts throughout the several views, there is shown a bath shaker 20 having an upper housing 21 and a lower housing 22. The upper housing 21 primarily houses a tank 23 having an open top 24, side walls 25, 26, a bottom wall 27, a front wall 28 and a rear wall 29. Rear wall 29 and front wall 28 carry U-shaped brackets 31 on which respective baffles 32, 33 are removably mounted. A shelf 34, on which a number of vessels 35 may be mounted via clamps 36, is suspended in the tank 23 via a tubular shelf carrier 37.

Figure 10:
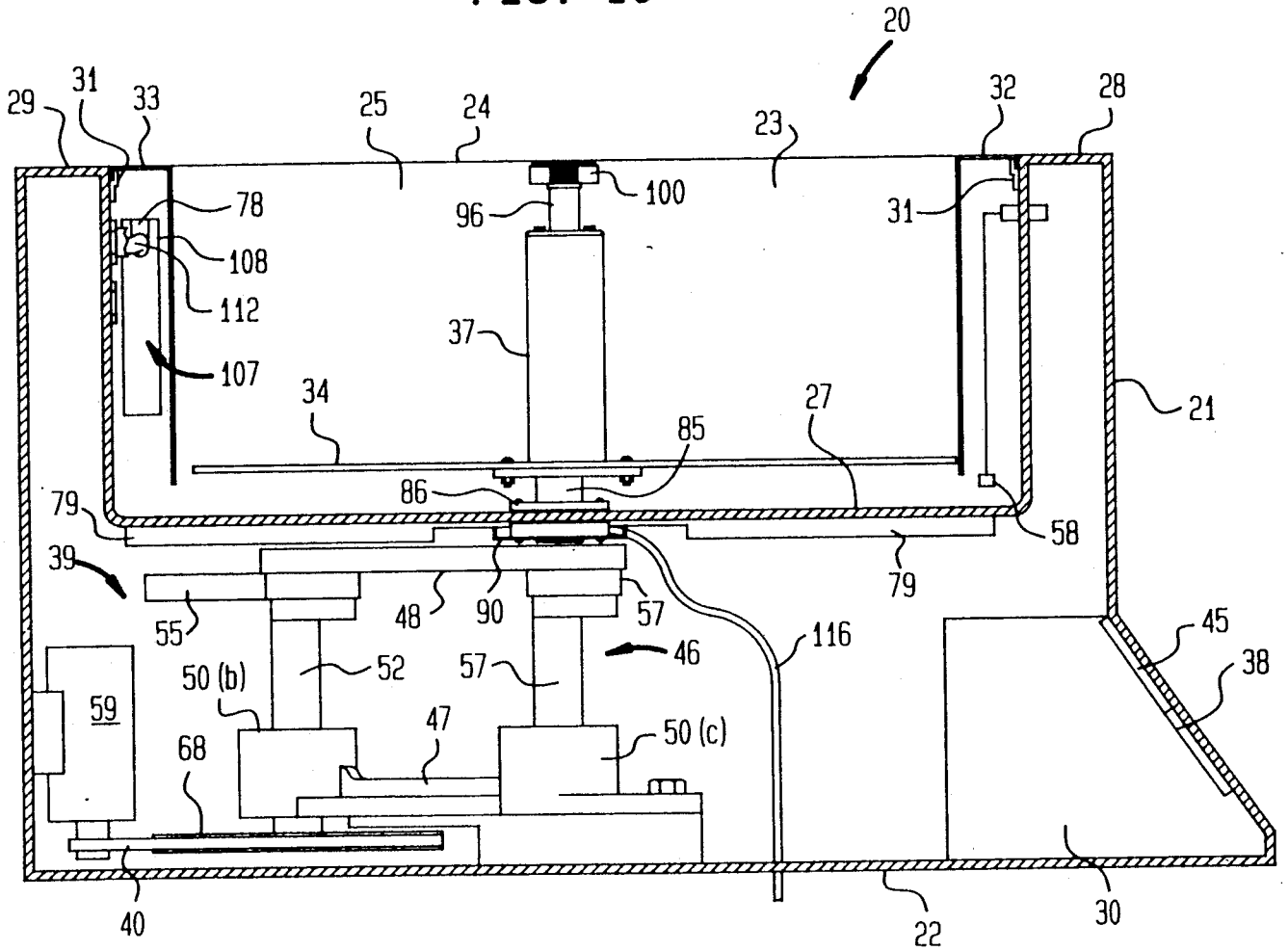
FIG. 10 is a cross section of the device shown in FIG. 1 taken on the line 10—10 of FIG. 1 and looking in the direction of the arrows.
Figure 11:
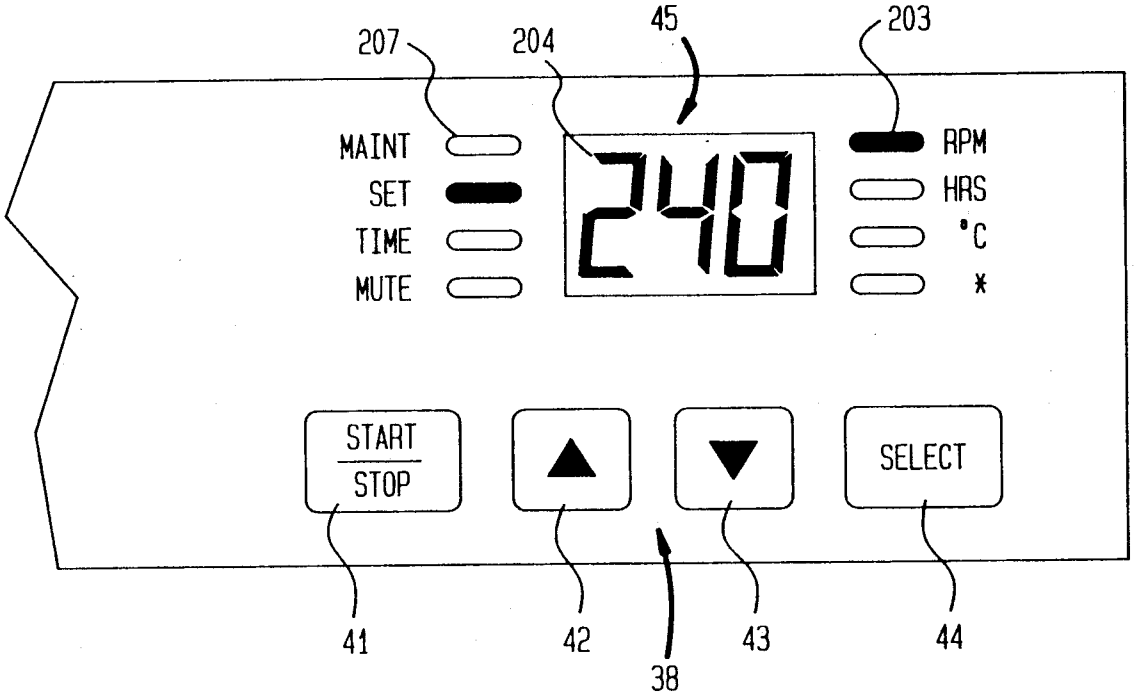
FIG. 11 is a plan view of a detail of a portion of the preferred embodiment.

The lower housing 22 primarily houses an electronic control system 30 and a shaker drive mechanism 39 (FIG. 10). The front face of housing 22 includes a keypad 38 and a display 45 (FIG. 11). Keypad 38 has four push-button key pads 41, 42, 43 and 44 for use by an operator to control the shaker 20.

Figure 4:
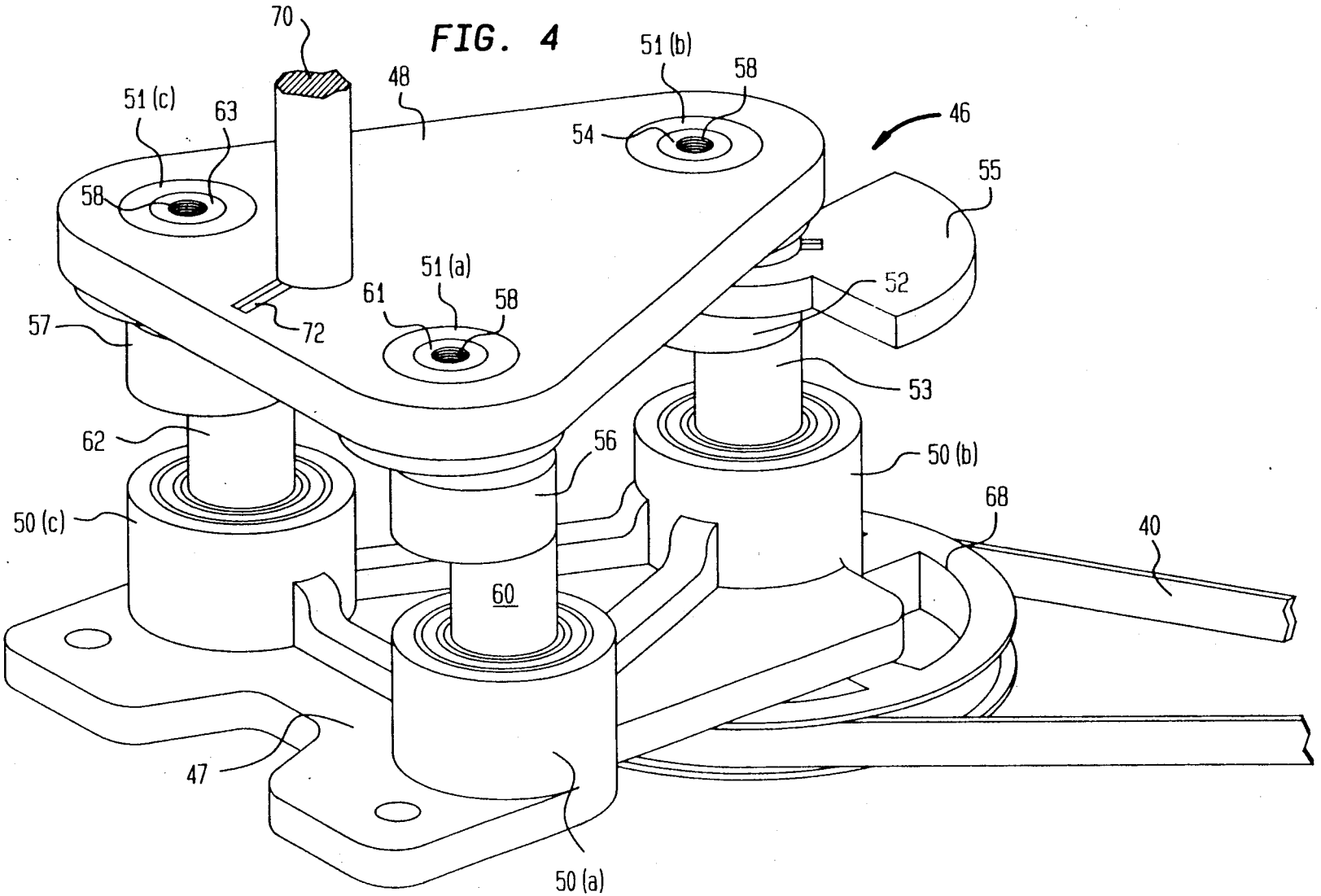
FIG. 4 is a pictorial view of a detail of the preferred embodiment with parts broken away.
Figures 8, 8A:
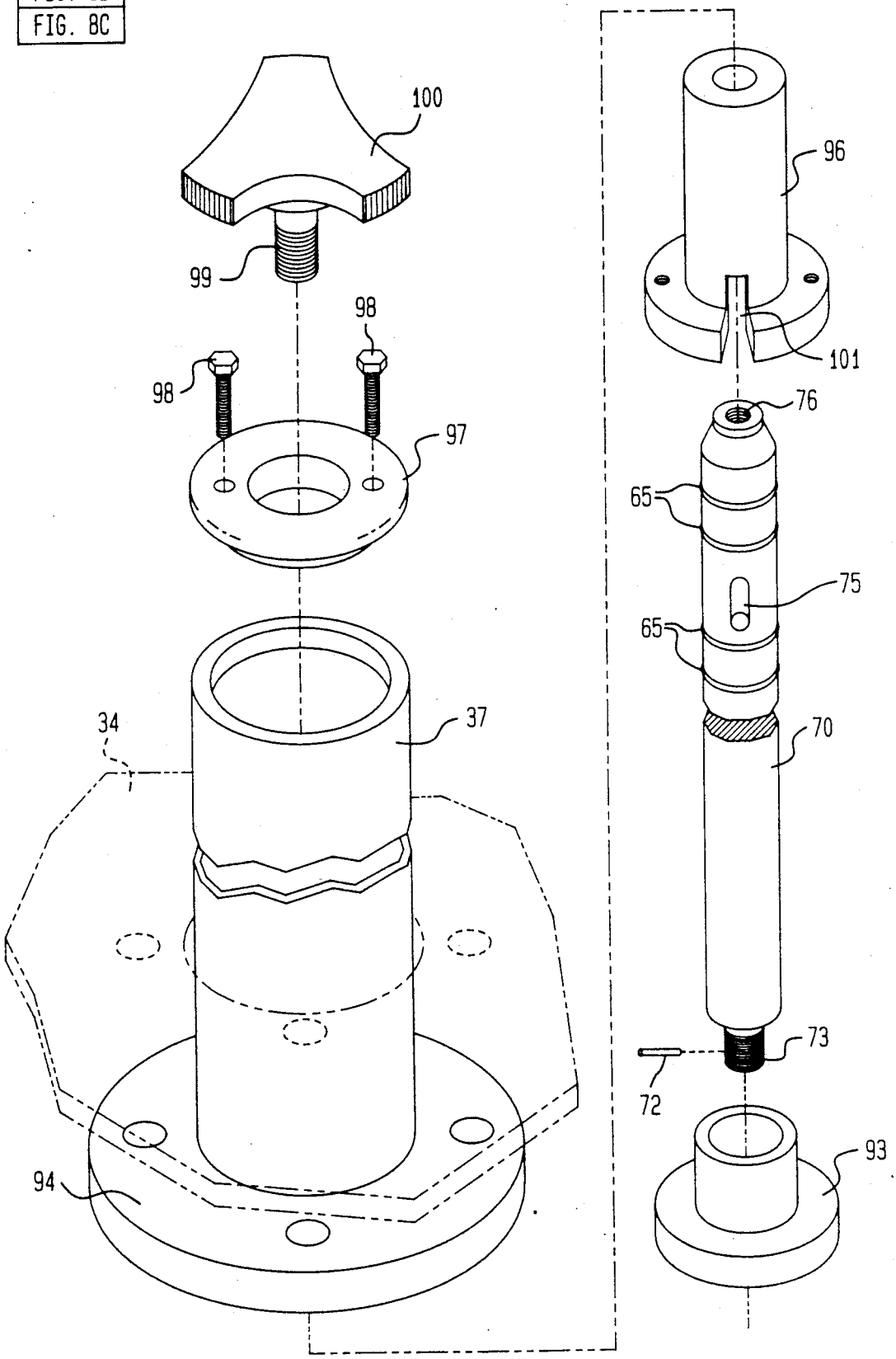
FIG. 8 is a diagram showing the relationship of FIGS. 8A–8C with respect to each other.
FIGS. 8A–8C are exploded pictorial views of a portion of the preferred embodiment.
Figure 8B:
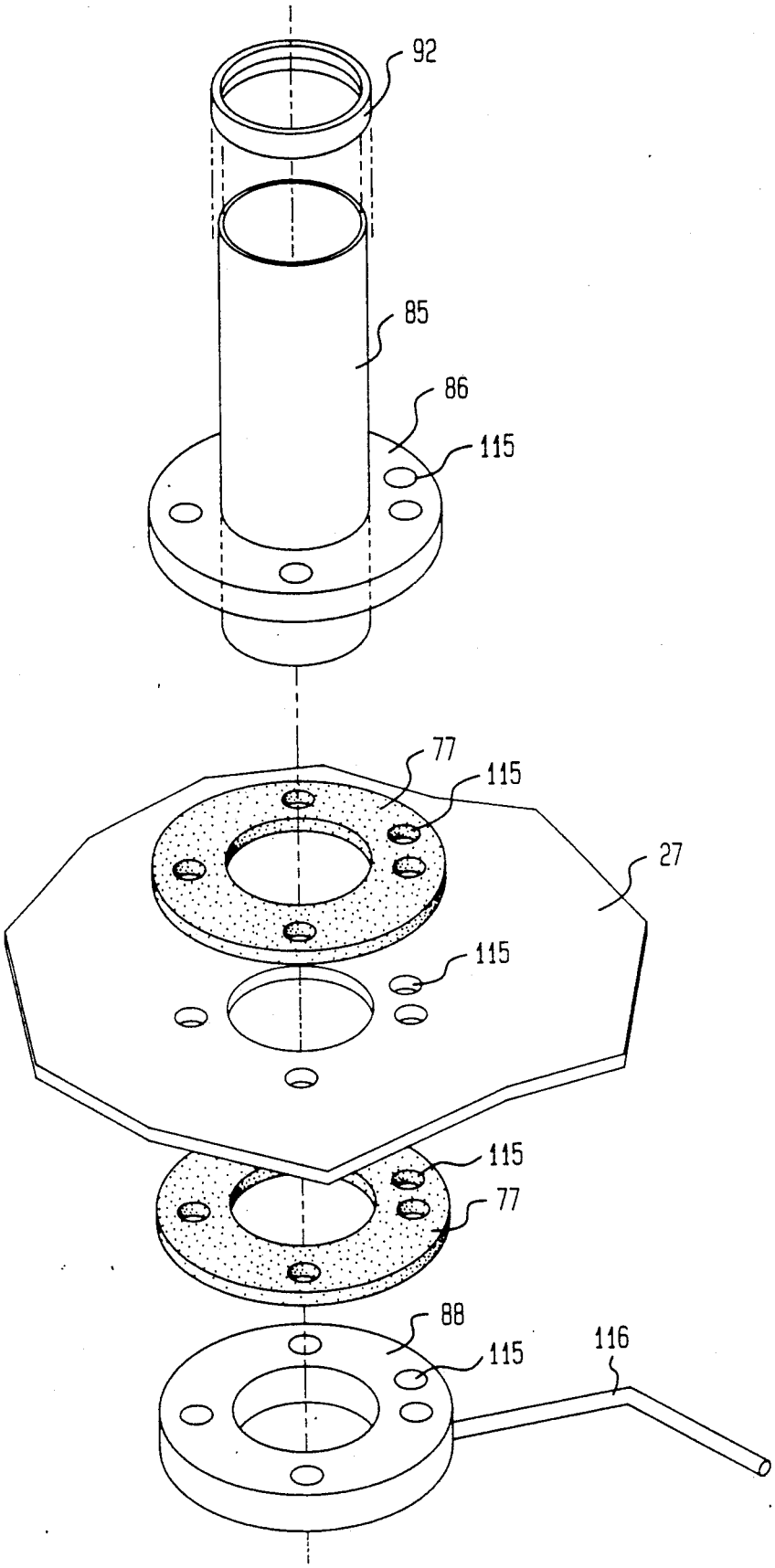
Figure 8C:
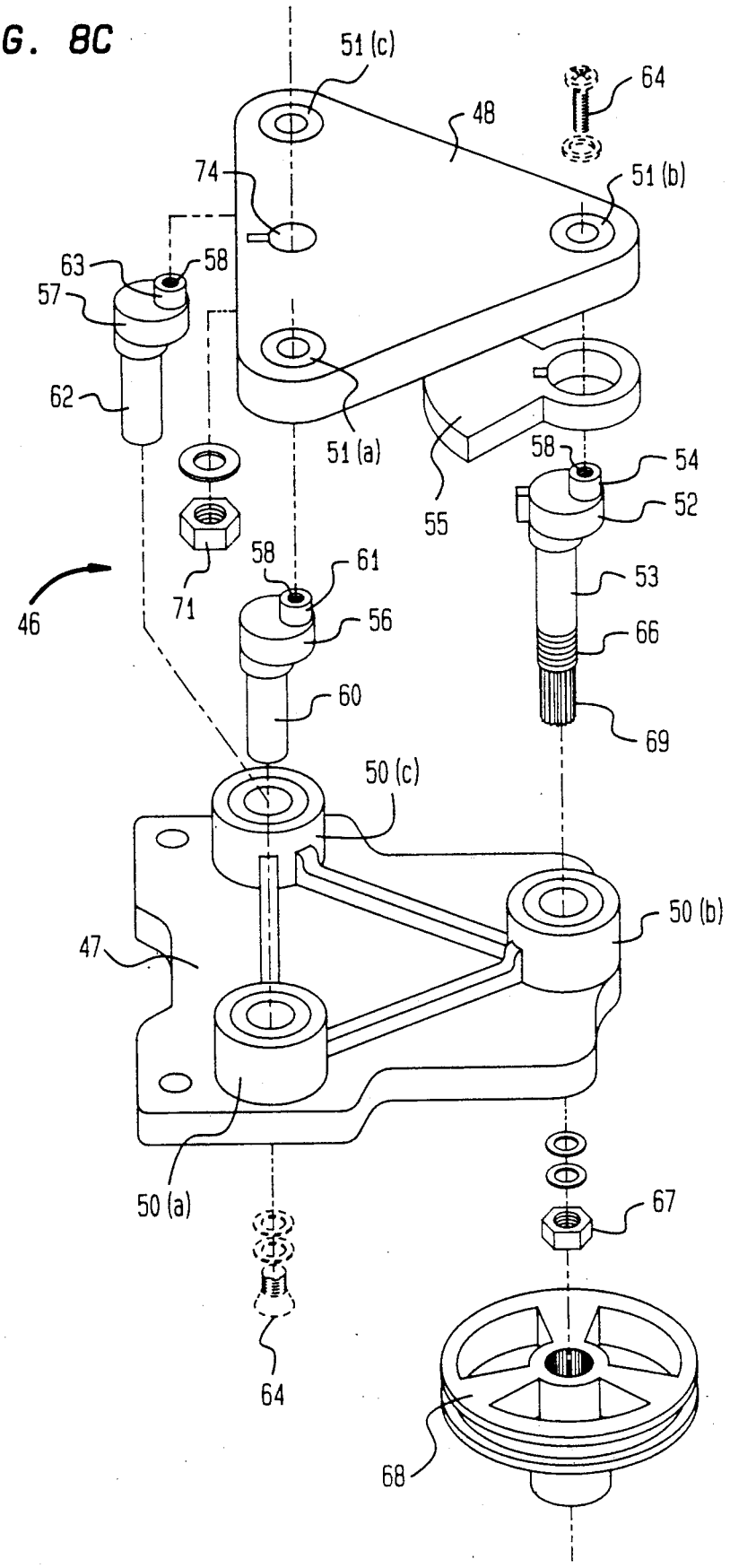

FIGS. 4 and 8C illustrate details of the drive mechanism 39. A triple eccentric 46 is employed to convert a pure rotational motion of an electric drive motor 59 into an orbital gyratory motion of the shelf 34. The triple eccentric 46 includes a stationary lower bearing housing 47 and a moveable upper bearing housing 48, each having three spaced bearings 50(*a*)-50(*c*) and 51(*a*)-51(*c*), respectively. A drive eccentric 52 has a first shaft 53 mounted for rotation in bearing 50(*b*), and a second shaft 54 mounted for rotation in bearing 51(*b*). Shafts 53 and 54 have parallel axes that are offset from each other by an amount equal to the desired eccentricity. A counterweight 55 is keyed onto eccentric 52 for rotation with the eccentric 52 about the axis of the shaft 53. A pair of idler eccentrics 56, 57 have offset shafts 60, 61 and 62, 63, respectively. Offset shafts 60, 61 are rotatably mounted in bearings 50(*a*) and 51(*a*), respectively. Shafts 62, 63 are rotatably mounted in bearings 50(*c*) and 51(*c*), respectively.

The eccentrics 52, 56 and 57 are fixed in bearings 50(*a*)-50(*c*) and 51(*a*)-51(*c*) by conventional means such as the bolt 64 and washers shown in dashed line in FIG. 8C. Bolts 64 may be threaded into threaded bores 58 in the ends of shafts 54 and 60–63. The bottom end of shaft 53 has a threaded portion 66 that receives nut 67 for securing shaft 53 in bearing 50(*b*). A drive pulley 68 is secured onto the lower grooved portion 69 of shaft 53 via a conventional fastening means (not shown) such as a set screw or the like. A drive belt 40 is used to transmit power from motor 59 to pulley 68 (FIG. 10).

A drive shaft 70 is bolted and pinned onto the housing 48 via nut 71 and pin 72. The threaded lower end 73 of shaft 70 passes through opening 74 in housing 48 for this purpose. Pin 72, fixed in the lower end 73 of shaft 70, is received in a slot located in the upper surface of housing 48 to prevent movement of the shaft 70 with respect to housing 48. Near the upper end of shaft 70, a radial index pin 75 (FIGS. 6, 8A) extends through the shaft 70. Two pair of O-rings 65 are mounted on the shaft 70 on either side of the pin 75. The upper end of shaft 70 is tapered and has an axial threaded bore 76.

Figure 5:
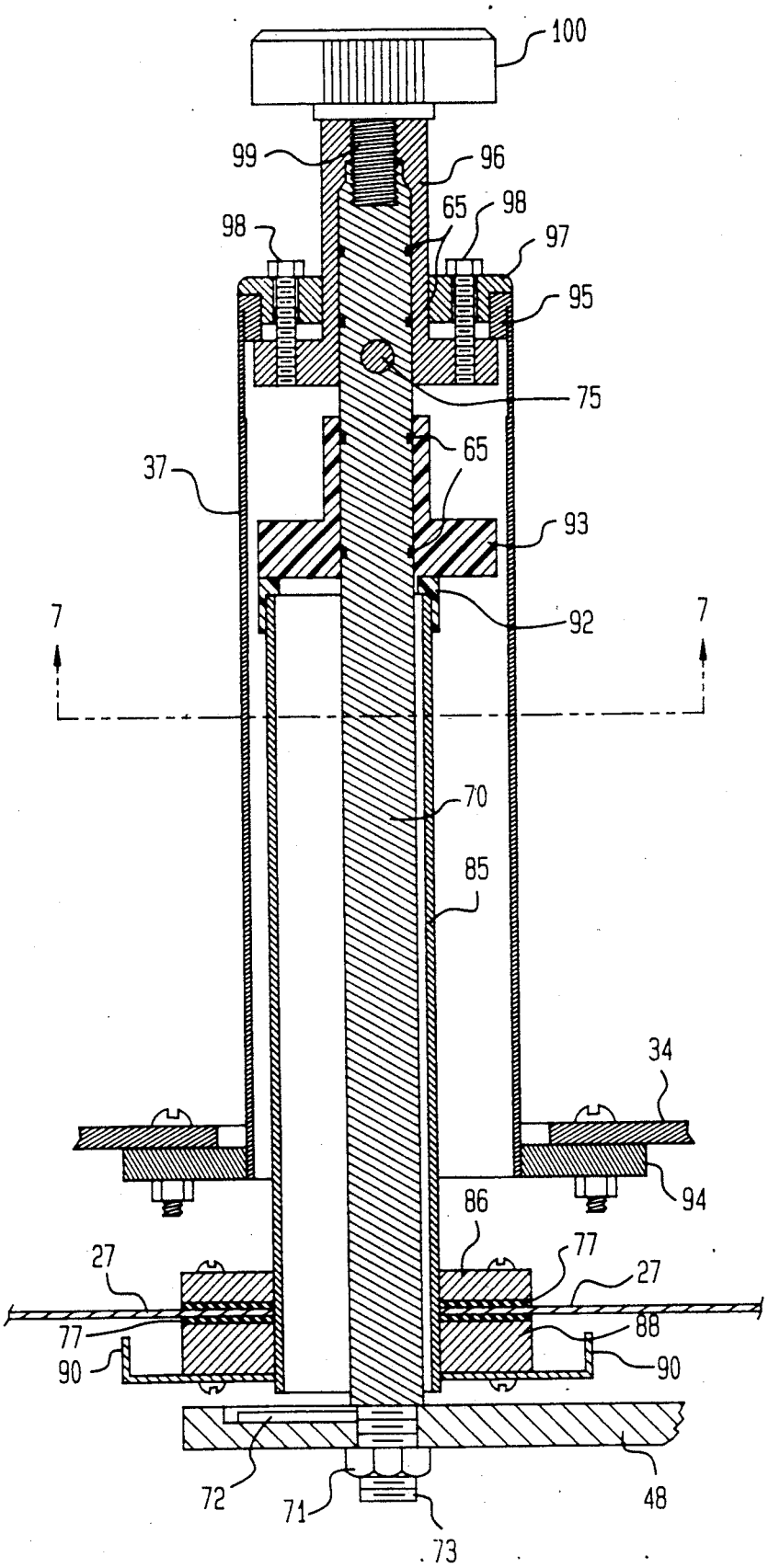
FIG. 5 is an elevation in cross section of a portion of the preferred embodiment.
Figure 6:
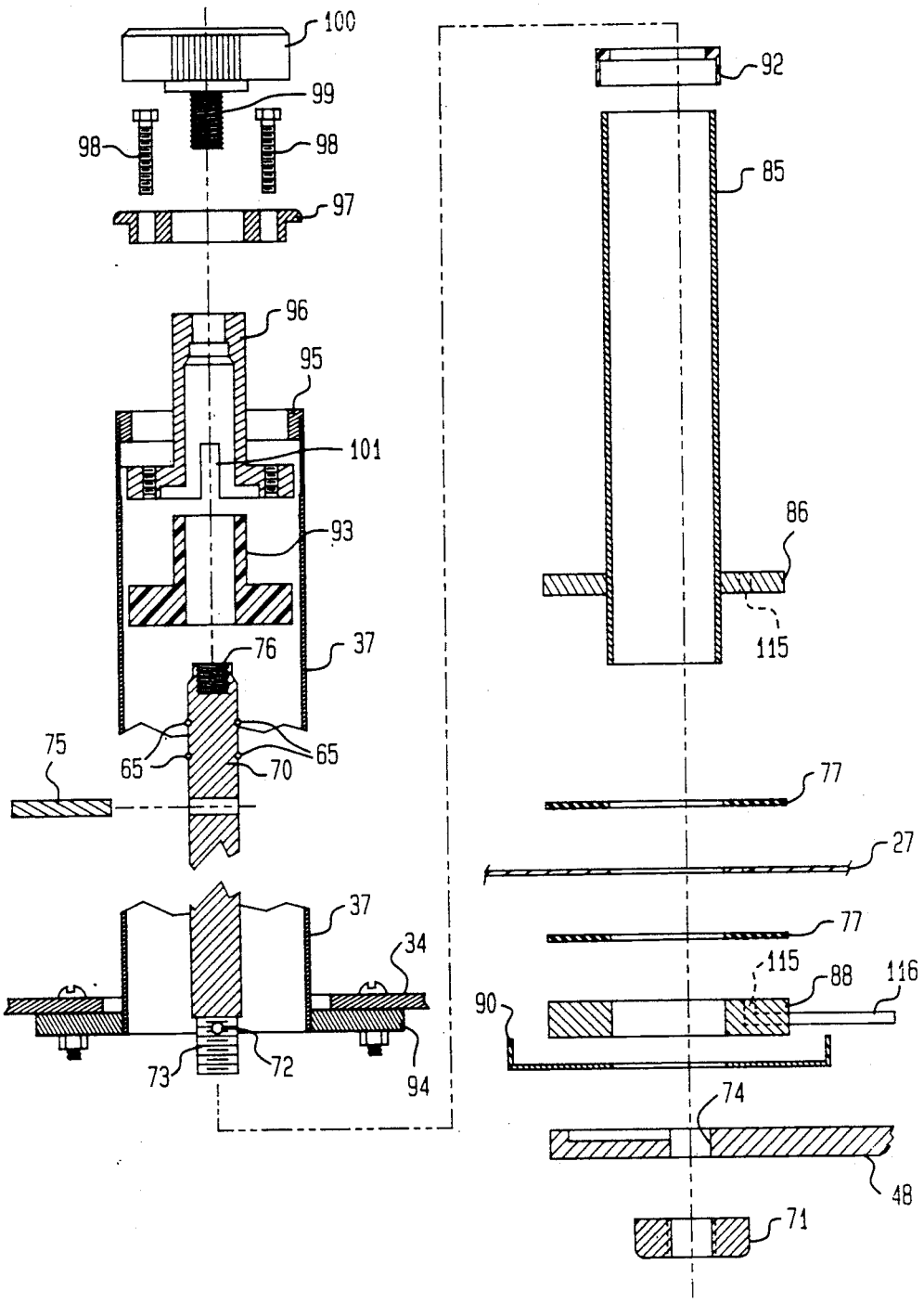
FIG. 6 is an exploded elevation in cross section of the device shown in FIG. 5.

As seen in FIGS. 5 and 6, the bottom wall 27 has a central opening through which a hollow standpipe 85 extends to a height above the bottom wall 27 that exceeds the intended maximum depth of the water in the tank 23. The lower portion of standpipe 85 has a mounting flange 86 fixed thereto. Gaskets 77, placed on either side of the lower wall 27, are sandwiched between the flange 86, the lower wall 27, and a standpipe mount 88. The flange 86, the gaskets 77 and the mount 88 have bolt-receiving openings therein that align with each other and with corresponding openings in the bottom wall 27 and in a channel bracket 90. The bracket 90 is fixed to the inside surface of the side walls of upper housing 21 and provides support for the standpipe 85 and the central area of the lower wall 27.

The upper end of standpipe 85 has a ring-shaped lower seal 92 that is frictionally fit thereon. The standpipe 85 is preferably made of stainless steel as is most of the elements that come into contact with the water in the tank 23. The lower seal 92, which is located above the top surface of the water, is preferably made of Teflon or other smooth material for a purpose that will become clear later.

The triple eccentric 46 is mounted below the standpipe 85 so that the shaft 70 will extend from the housing 48 through the standpipe 85. An upper seal 93, made of Teflon or like material, is frictionally fit over the lower 0-rings 65 on shaft 70. The disk-shaped lower surface of upper seal 93 makes sliding contact with the upper surface of lower seal 92. The abutting surfaces of seals 92, 93, free to slide on each other, form a water tight seal to prevent water from splashing into the hollow interior of standpipe 85.

Figure 7:
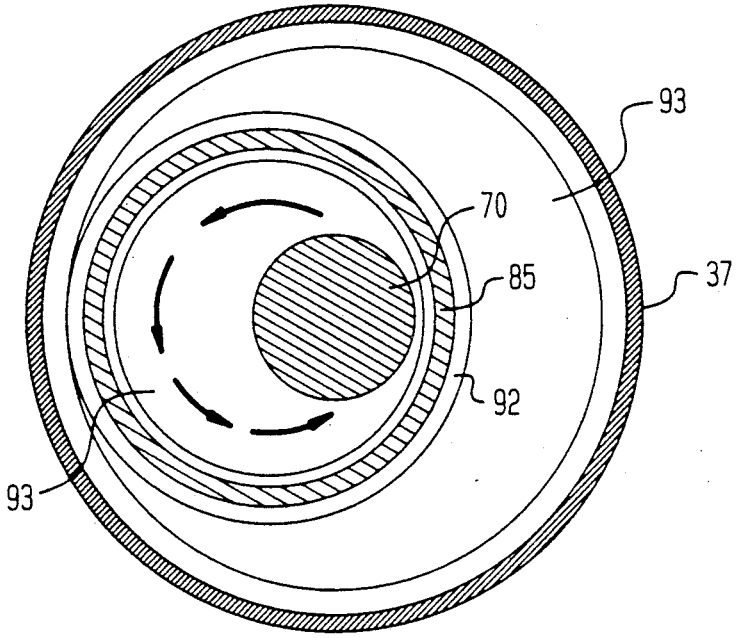
FIG. 7 is a cross sectional bottom view taken on the line 7—7 of FIG. 5 looking in the direction of the arrows.

The standpipe 85 is generally cylindrically shaped, having a diameter of a sufficient size to permit the drive shaft 70 to move therein in a circular orbit when driven by triple eccentric 46 (see arrows in FIG. 7). As the shaft 70 moves in its circular orbit, the upper seal 93 will move with shaft 70 while maintaining sealing contact with seal 92. The drive shaft 70 functions to completely support and shake the vessel-carrying shelf 34 via the shelf carrier 37.

The shelf carrier 37 has a flange 94 welded or otherwise fixed to its lower edge. The shelf 34, a generally flat member, has a central opening through which the carrier 37 extends such that the undersurface of the shelf 34 adjacent the central opening rests on the flange 94 to be bolted thereto. The upper end of carrier 37 (FIG. 5) has a flange 95 on which a cap 96 is clamped via a ring 97 and bolts 98. Cap 96 includes slot 101 for receiving index pin 75. The cap 96 is secured onto the upper end of the shaft 70 by securing the threaded shaft 99 into the threaded bore 76 via the hand knob 100. Alignment of the shelf 34 in the tank 23 is accomplished by placing the cap 96 onto the shaft 70 with the slots 101 aligned with the pin 75. In FIG. 6, pin 75 and shaft 70 are ninety degrees out of alignment with the slot 101 for illustration purposes.

The motion of the shelf 34 will follow the motion of the upper bearing housing 48 which acts as a platform on which the drive shaft 70 is rigidly fixed. The motion of the housing 48 is such that each point on its upper surface will rotate at a common speed about a different center. It is noted that the three points defined by the intersection of the axes of shafts 54, 61 and 63, and the plane of the upper surface of housing 48 will rotate about three different centers, namely, the axes of shafts 53, 60 and 62, respectively. In like manner each of the points on the upper surface of housing 48 will also rotate at that same speed about a different center. The shaft 70, fixed to the housing 48, will assume the same orbital motion and thereby drive the shelf 34 in like manner. Accordingly, each of the vessels 35 will orbit with the shelf 34 on which it is fixed.

Figure 2:
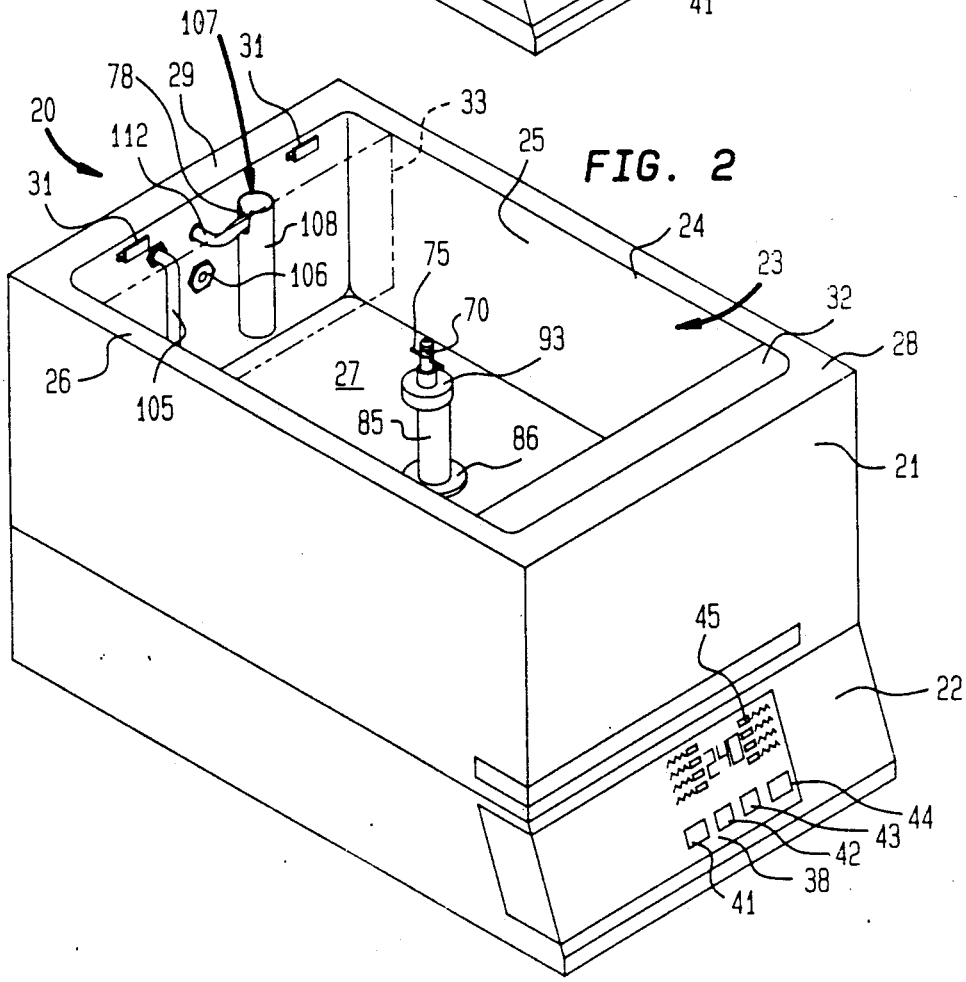
FIG. 2 is a pictorial view, similar to the view shown in FIG. 1, with parts removed.
Figure 3:
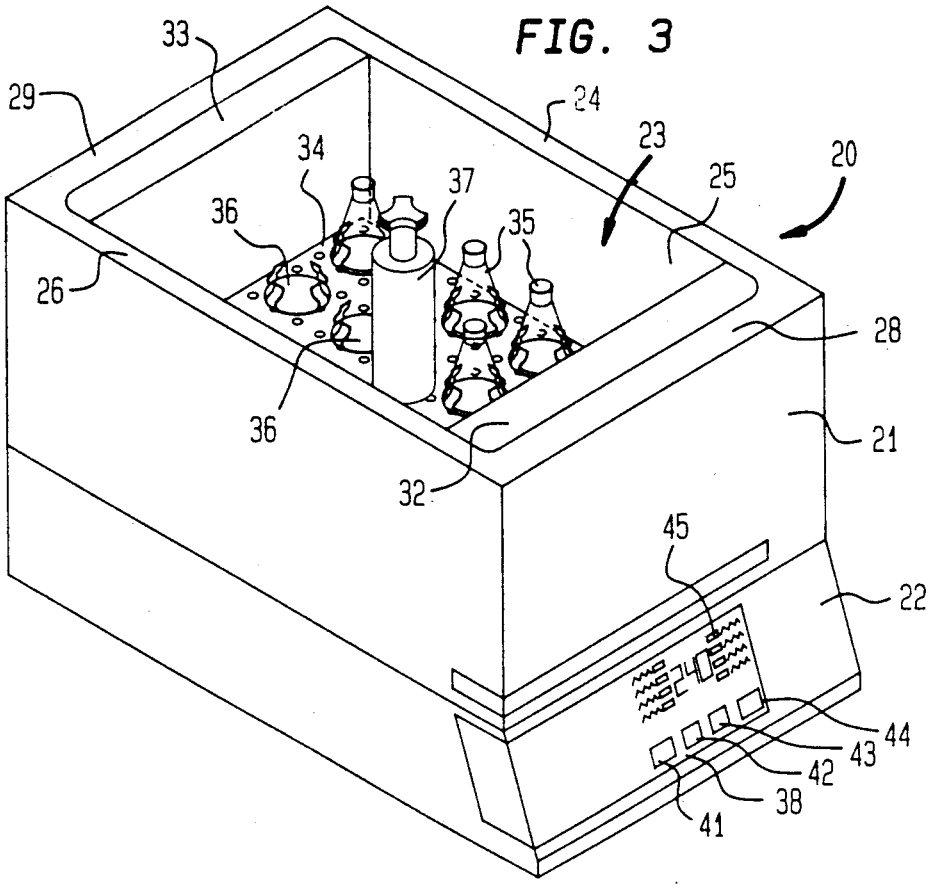
FIG. 3 is a pictorial view, similar to the view shown in FIG. 1.
Figure 9:
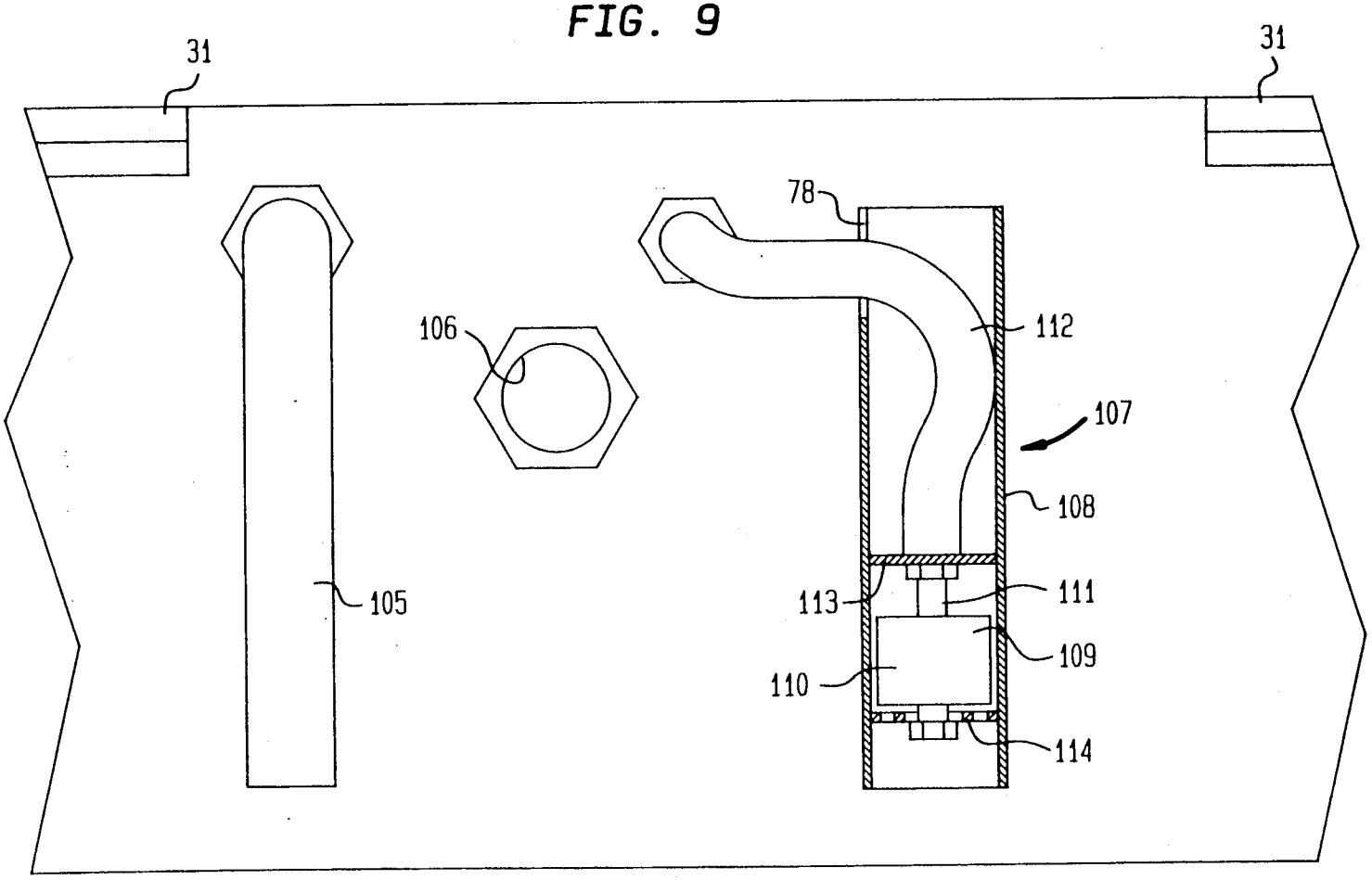
FIG. 9 is an elevation, partly in section, showing details of the preferred embodiment.

FIGS. 2, 9 and 10 show the exposed inside surface of wall 29. Tube 105 represents the water inlet tube for filling the tank 23 with the proper amount of water. Opening 106 represents a water overflow outlet to prevent accidental overflow of the tank 23. A water level control 107 includes a tubular guide 108 in which a magnetic float switch 109 is adjustably mounted. Switch 109 includes a floatable magnet 110 slidably mounted on a switch post 111. A magnetic reed switch 49 (FIG. 12) is sealed inside post 111 and is connected to the conductors of a flexible electric cable 112. Post 111 is secured to a pair of washers 113, 114 that are fit in the interior of guide 108 to center the magnet 110. The water depth in the tank 23 is adjusted by pulling or pushing on the cable 112 to move the float switch 109, along with washers 113 and 114, to a desirable height. When water reaches a height in the tank 23 to cause magnet 110 to float upwardly on the post 111, the reed switch 49 (FIG. 12), which is housed in post 111 and is connected to conductors in cable 112, will open thereby opening a circuit via the cable 112 that will deenergize a water supply solenoid 218 (FIG. 12) to automatically shut off the water entering the tube 105. The cable 112 is secured in a slot 78 in the upper end of guide 108.

The tank 23 is drained of water via a drainage opening 115 that passes through the flange 86, the gaskets 77, the bottom wall 27 and the standpipe mount 88. A water drainage tube 116 communicates with the opening 115 in mount 88 to carry water from the tank 23 to an appropriate drainage system.

FIG. 11 illustrates the details of the keypad 38 and display 45. Display 45 has four function indicator lights 203 and four status indicator lights 207. Only one of the lights 203 is lit at any particular time. Status indicator lights 207 may be lit in various combinations to reflect the system status. Display 45 also has a character display portion 204.

The pads 41, 42, 43 and 44 are preferably combined into a tactile membrane switch. The START/STOP pad 41 is used primarily to stop or start the shelf 34 from shaking (power to the shaker 20 is controlled by a separate switch, preferably at the rear or side of the shaker 20). The SELECT pad 44 is used to select the various shaker functions. For example, to initiate a timed run, the SELECT pad 44 is depressed until the function indicator light 203 adjacent HRS is illuminated. At this point, the character display portion 204 of display 45 will also be lit indicating a particular number of hours which represents the running-time setpoint. T increase or decrease the running-time setpoint, the up-arrow pad 42 or the down-arrow pad 43, respectively, is depressed. At this point, the status indicator light 207 adjacent SET will be illuminated to indicate that the pads 42, 43 are being activated. The number displayed in portion 204 at this point will be the present running-time setpoint. The operator will be made aware of this by having the HRS indicator light 203 illuminated. To start a timed run, the START/STOP key 41 must be activated while the SET indicator light 207 is lit (it will go out automatically after three seconds). At this point, the shelf 34 will begin shaking and the indicator light 207 adjacent TIME will be lit to indicate that a timed run is in progress. During the run, the portion 204 will display numbers that represent the time remaining in the run. To cancel a timed run, the SELECT pad 44 is activated until the HRS indicator light 203 lights. Either one of the setpoint pads 42 or 43 is then activated, the START/STOP pad 41 is pressed, and the portion 204 then reads OFF.

In like manner, the water temperature may be set. The first step in setting the water temperature is to activate the SELECT pad 44 until the C indicator light 203 lights. This action causes the portion 204 to display the current water temperature. The appropriate setpoint pad 42 or 43 is pressed to adjust the setpoint temperature reading in portion 204. Again, the SET indicator light 207 will have been lit and will stay lit as long as a pad 42 or 43 is being activated. When the SET indicator light 207 goes out after the usual 3-second pause, the temperature setpoint that is displayed on portion 204 will be stored in memory and the portion 204 will resume displaying the current water temperature because the ° C. light 203 is lit.

If the SELECT pad 44 is activated to light the RPM indicator light 203, the portion 204 will then read the current shaker speed in revolutions per minute. The speed setpoint may now be adjusted via pads 42, 43 while the operator observes the portion 204 which will display the selected setpoint in a manner similar to that used to set the temperature setpoint.

The MAINT indicator light 207 will light automatically as a maintenance alert indicator when the shaker 20 has reached a predetermined total running time such as 10,000 hours. When there has been a power interruption, the portion 204 will flash. Any key may be pressed to stop this flashing.

When the actual water temperature is one degree centigrade above or below the temperature setpoint, the ° C. indicator light 203 flashes. The "*" indicator light 203 will flash when the water level in tank 23 has not yet reached its setpoint level as set by the height of float relay 109 or whenever the water bath is in a low-water condition. An audible alarm provides an additional warning when any one of a number of functional deviations exists. This audible alarm may be muted by activating certain pads in a predetermined order. An example of one such procedure that may be used is as follows: first, press SELECT pad 44 until the HRS indicator is lit; simultaneously press the two set point pads 42 and 43; and then press the START/STOP pad 41. In response, the MUTE indicator light 207 will then light to indicate that the audible alarm is disabled. At the same time, the character display section 204 may be used for some purpose, e.g. to display the total number of operating hours accumulated.

Figure 12:
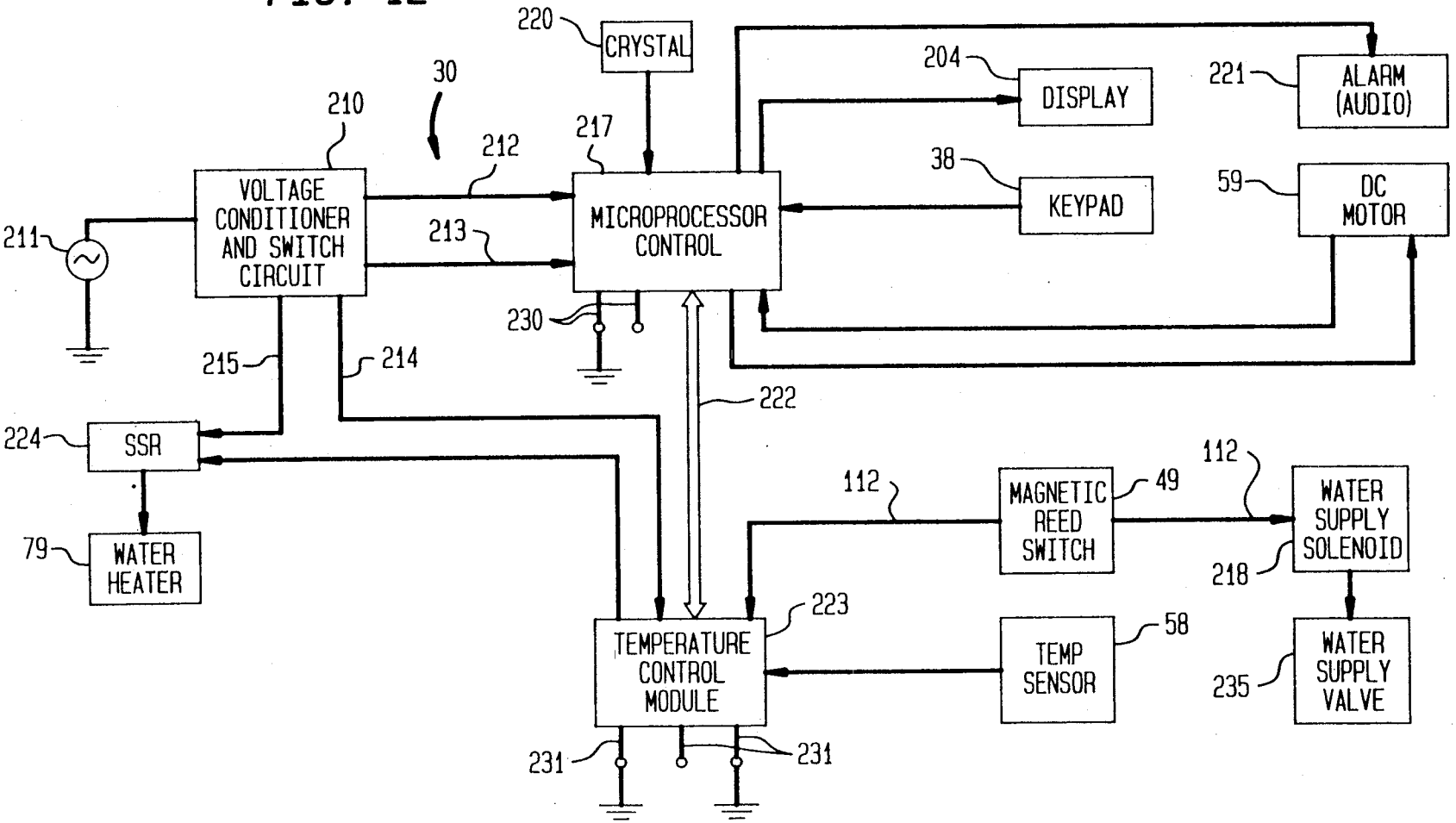
FIG. 12 is a block diagram of the electronic control circuit of the preferred embodiment.

FIG. 12 is a schematic block diagram of the major electrical components of the control system 30 for operating the bath shaker 20 to perform the function just described. A voltage conditioner and switch circuit 210 is connected to a conventional AC power source 211. Circuit 210 may include a manual switch for permitting a user to connect the system 30 to any one of a variety of different types of power sources 211. Circuit 210 includes conventional voltage conditioning circuits for performing such functions as voltage rectification and regulation to provide a number of different output voltages to the components via lines 212, 213, 214 and 215.

A microprocessor control 217 has outputs connected to display 204, to DC motor 59, to audio alarm 221, and to an input/output bus 222 connected to a temperature control module 223. Control input lines are connected to microprocessor control 217 from keypad 38, DC motor 59 and temperature control module 223. A crystal 220 is connected to microprocessor control 217 for providing a timing signal.

The microprocessor control 217 and the temperature control module 223 may have utility in multiple types of shaking machines with or without water baths. As such, the preferred embodiment of the control 217 and module 223 include means for detecting the type of machine in which they are installed. For this purpose machine harnesses 230 and 231 are connected to the control 217 and 223, respectively, when installed in the shaker 20. The harnesses 230 and 231 have a number of conductors with selected ones grounded depending on the type of shaker in which the harnesses 230, 231 are installed. When power is applied to the system 30 via source 211, the control 217 and module 223 will first step through a routine to detect which of the conductors of harnesses 230 and 231 are grounded. In response, the module 223 and control 217 will use this information to provide the proper control outputs to the various components. It is necessary to inform control 217 that it is installed in a water-bath type shaker. This information is detected by control 217 when it senses which ones of the conductors in harness 231 are grounded. In response, the control 217 will be initialized to perform the various function necessary to control a water bath shaker, such as temperature control.

A water temperature sensor 58 is mounted on the inside of the front wall 28 behind baffle 32 (FIG. 10). Sensor 58 passes through the upper portion of wall 28 and has a waterproof electrical conductor that suspends the sensor 58 in the lower portion of tank 23. Sensor 58 is connected to the module 223 for providing water temperature data. If the temperature sensor 58 indicates a water temperature below the setpoint temperature which was inputted via keypad 38 and memorized by control 217, an enable signal is transmitted to a solid state relay (SSR) 224 to apply power to the water heater 79 mounted on the undersurface of bottom wall 27 (FIG. 10).

The magnetic reed switch 49 of water level control 107 (FIG. 9) will provide a signal via cable 112 when the water level in tank 23 has reached the desired level as set by the position of the floatable magnet 110. If the water in the tank 23 has not yet reached its desired level, the reed switch 49 will open a water supply valve 235 via water supply solenoid 218. The output of valve 235 is connected to water tube 105 (FIG. 9). When the water level in tank 23 has reached its appropriate level, switch 49 will operate to close valve 235 via solenoid 218. The module 223 will monitor the condition of switch 49.

As described above, the desired speed of the shaker is adjusted by inputting an RPM setpoint to control 217 via keypad 38. Control 217 uses this RPM setpoint to control the speed of DC motor 59. The speed control signal to DC motor 59 is timed by control 217 so as to gently accelerate and decelerate the motor 59 so that there will be only a minimum amount of splashing of the bath water. For this purpose, a feedback connection is shown between motor 59 and control 217.

For those skilled in these arts can produce routines for microprocessor control 217 that can cyclically monitor the various inputs, such as the temperature, speed and water level to provide outputs to the display 204 and the audio alarm 221. As described earlier, the temperature, speed, and running time are displayable on display 204 when the proper inputs are transmitted to control 217 via keypad 38. The running time, is accumulated by control 217 and is used to automatically stop the shaker 20. The total accumulated running time is stored in control 217 and outputted to display 204 as described earlier. The total running time is used to operate the MAINT light 207.

It should be understood, of course, that control 217 may be programmed to perform a variety of additional functions. Obviously, many modifications and variations in the structure and function of the present invention are possible in the light of the above teachings. It is therefore to be understood, that within the scope of the appended claims, the invention may be practiced otherwise than as specifically described.

What is claimed is:

1. A water bath shaker comprising:

a shelf having means for carrying a plurality of vessels;

a tank having side walls, an open top and a bottom wall with an opening therein;

a standpipe having a lower end sealingly mounted in said opening and an upper end spaced above said bottom wall;

a drive means mounted below said bottom wall having a movable member that orbits in a plane such that a plurality of points thereon each rotate at a common speed about different centers;

a drive shaft having a lower end fixed to said movable member, an intermediate end extending through said standpipe and an upper end spaced above the upper end of said standpipe, said upper end of said shaft including mounting means for fixing said shelf thereto such that said shelf is free to orbit in said tank; and sealing means for preventing water in said tank from entering the upper end of said standpipe.

2. The shaker of claim 1 wherein said tank and said shelf are rectangular.

3. The shaker of claim 1 wherein said sealing means includes a rigid seal mounted on said shaft, said seal having a flat surface that covers the top end of said standpipe.

4. The shaker of claim 1 wherein said sealing means includes a ring sealingly mounted on the upper end of said standpipe and a disk sealingly mounted on said shaft in sliding contact with said ring.

5. The shaker of claim 4 wherein said shelf includes a flat surface and an upstanding carrier having means cooperating with said mounting means for fixing said shelf to said shaft.

6. The shaker of claim 5 wherein said carrier includes a tubular member joined to said flat surface and extending over said standpipe and said shaft,

7. The shaker of claim 6 wherein said tubular member and said shaft include index means for orienting said shelf in a predetermined position in said tank.

8. The shaker of claim 7 wherein said index means includes an index pin mounted on said shaft and a pin-receiving slot, formed in said tubular member.

9. The shaker of claim 1 wherein said drive means includes at least three eccentrically mounted rotatable shafts rotatably joined to said movable member.

10. The shaker of claim 9 wherein said drive means includes a motor having means for rotating one of said eccentrically mounted shafts.

11. The shaker of claim 1 further including a control means having a manual input means for inputting preselected operating set points.

12. The shaker of claim 11 wherein said control means includes motor speed regulating means responsive to at least one of said set points.

13. The shaker of claim 12 wherein said control means further includes a water level controller including a floatable level detector adjustably mounted in said tank.

14. The shaker of claim 11 further including a heater means for heating water in said tank.

15. The shaker of claim 14 wherein said control means includes a temperature sensor mounted in said tank and means for energizing said heater in response to said temperature sensor and at least one of said set points.

16. The shaker of claim 15 wherein said control means includes means for determining the type of shaker to be controlled.

* * * * *